US011186080B2

(12) United States Patent
Martin et al.

(10) Patent No.: US 11,186,080 B2
(45) Date of Patent: Nov. 30, 2021

(54) REFERENCE MEASUREMENTS OF FLUIDIC ACTUATORS

(71) Applicant: HEWLETT-PACKARD DEVELOPMENT COMPANY, L.P., Spring, TX (US)

(72) Inventors: Eric T. Martin, Corvallis, OR (US); Daryl E. Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,819

(22) PCT Filed: Apr. 6, 2018

(86) PCT No.: PCT/US2018/026552
§ 371 (c)(1),
(2) Date: Oct. 8, 2019

(87) PCT Pub. No.: WO2019/194834
PCT Pub. Date: Oct. 10, 2019

(65) Prior Publication Data

US 2021/0283904 A1 Sep. 16, 2021

(51) Int. Cl.
*B41J 2/045* (2006.01)

(52) U.S. Cl.
CPC ..... *B41J 2/04508* (2013.01); *B41J 2/0458* (2013.01); *B41J 2/04581* (2013.01)

(58) Field of Classification Search
CPC ..... B41J 2/04573; B41J 2/04541; B41J 2/04586; B41J 2/05; B41J 2/0458; B41J 2/04508; B41J 2/04581; B41J 2/125
See application file for complete search history.

(56) References Cited

U.S. PATENT DOCUMENTS 6,130,683 A 10/2000 Ju
6,257,694 B1 7/2001 Tokumaru et al.
(Continued)

FOREIGN PATENT DOCUMENTS

EP 0080667 B1 6/1983
EP 1413435 A1 4/2004

OTHER PUBLICATIONS

Anderson et al International Appl. No. PCT/US2018/026543 entitled Decoders to Activate Fluidic Actuators for Sense Measurements filed Apr. 6, 2018 (43 pages).
(Continued)

*Primary Examiner* — Thinh H Nguyen
(74) *Attorney, Agent, or Firm* — Trop Pruner & Hu PC

(57) ABSTRACT

In some examples, a fluid dispensing device includes a plurality of fluidic actuators and a decoder. The decoder is to detect that an activated sense measurement is to be performed for a first fluidic actuator of the plurality of fluidic actuators in a first time group comprising a plurality of activation intervals for respective fluidic actuators. In response to detecting that the activated sense measurement is to be performed for the first fluidic actuator in the first time group, the decoder activates the first fluidic actuator in the first time group to perform the activated sense measurement for the first fluidic actuator, and suppresses an activation pulse to the first fluidic actuator in a second time group that follows the first time group to perform a reference measurement for the first fluidic actuator in the second time group, the second time group comprising a plurality of activation intervals for respective fluidic actuators.

15 Claims, 7 Drawing Sheets

(56) References Cited

U.S. PATENT DOCUMENTS

| | | | | |
|---|---|---|---|---|
| 6,616,256 | B1 | 9/2003 | Cook et al. | |
| 7,635,174 | B2 | 12/2009 | Bergstedt et al. | |
| 8,708,449 | B2 | 4/2014 | Shinkawa | |
| 8,899,711 | B2 | 12/2014 | Masuda et al. | |
| 9,493,002 | B2 | 11/2016 | Edelen et al. | |
| 9,776,395 | B2 | 10/2017 | Anderson et al. | |
| 2004/0080554 | A1* | 4/2004 | Kim | B41J 2/04541 347/12 |
| 2006/0125858 | A1 | 6/2006 | Silberbrook et al. | |
| 2008/0018678 | A1 | 1/2008 | Shimura | |
| 2008/0084444 | A1 | 4/2008 | Sheahan et al. | |
| 2010/0231625 | A1 | 9/2010 | Walmsley et al. | |
| 2011/0084997 | A1 | 4/2011 | Chen et al. | |
| 2013/0135372 | A1 | 5/2013 | Tabata et al. | |
| 2013/0278656 | A1 | 10/2013 | Covyadinov et al. | |
| 2013/0278657 | A1 | 10/2013 | Martin et al. | |
| 2014/0210881 | A1 | 7/2014 | Van Broklin et al. | |
| 2016/0271940 | A1* | 9/2016 | Martin | B41J 2/0451 |
| 2017/0146005 | A1 | 5/2017 | Edelen | |
| 2017/0225455 | A1 | 8/2017 | Veenstra et al. | |

OTHER PUBLICATIONS

Anderson et al. International Appl. No. PCT/US2018/026546 entitled Fluidic Actuator Activations for Sense Measurements filed Apr. 6, 2018 (40 pages).

Anderson et al International Appl. No. PCT/US2018/026548 entitled Sense Measurements Indicators to Select Fluidic Actuators for Sense Measurements filed Apr. 6, 2018 (68 pag.

Martin et al International Appl. No. PCT/US2018/026541 entitled Sense Measurements for Fluidic Actuators filed Apr. 6, 2018 (33 pages).

* cited by examiner

REFERENCE MEASUREMENTS OF FLUIDIC ACTUATORS

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
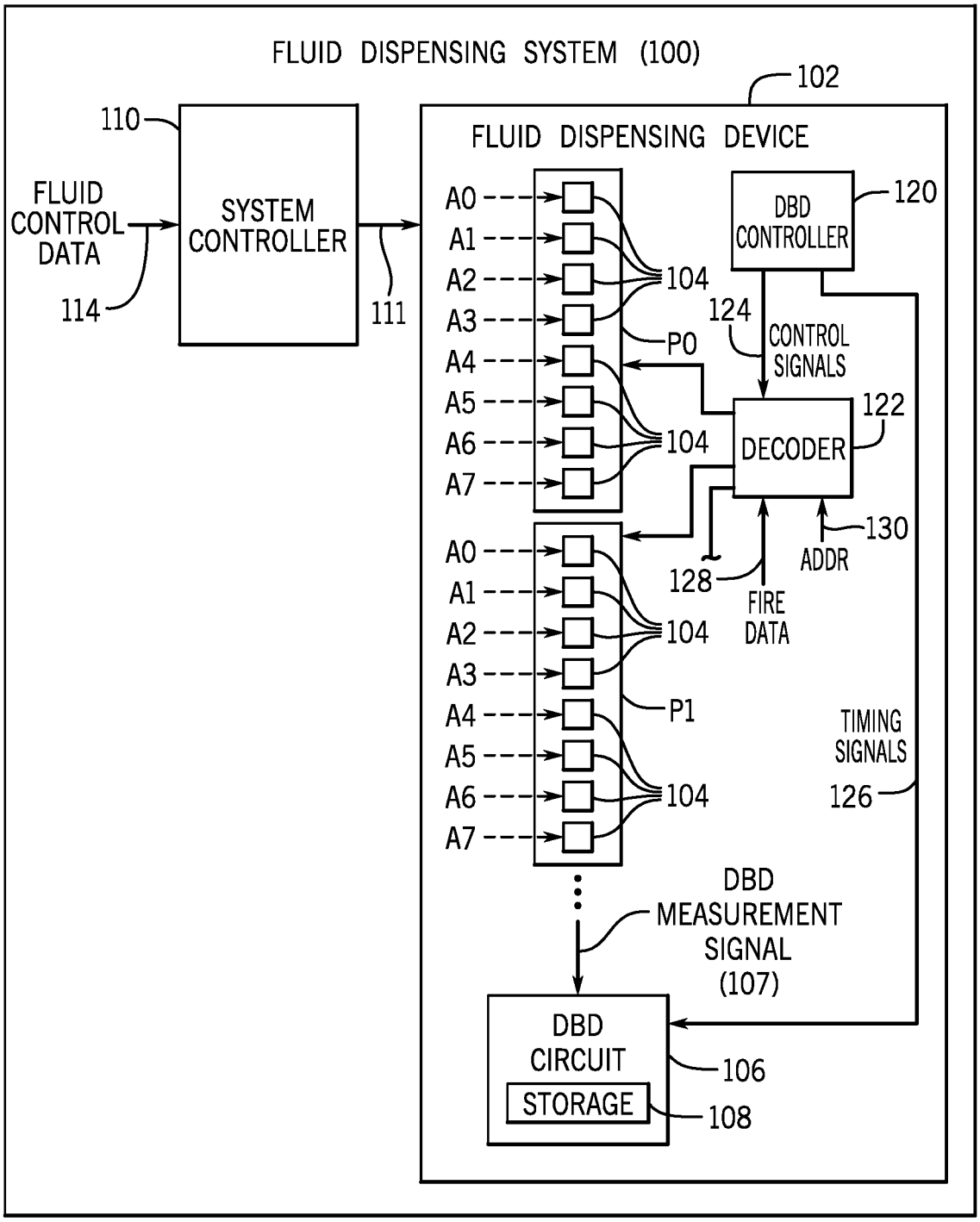
FIG. 1 is a block diagram of a fluid dispensing system including a system controller and a fluid dispensing device according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

Generally, a fluidic actuator can be an ejecting-type fluidic actuator to cause ejection of a fluid, such as through an orifice of a nozzle, or a non-ejecting-type fluidic actuator to cause flow of a fluid.

Activating a fluidic actuator can also be referred to as firing the nozzle. In some examples, the fluidic actuators include thermal-based fluidic actuators including heating elements, such as resistive heaters. When a heating element is activated, the heating element produces heat that can cause vaporization of a fluid to cause nucleation of a vapor bubble (e.g., a steam bubble) proximate the thermal-based fluidic actuator that in turn causes dispensing of a quantity of fluid, such as ejection from an orifice of a nozzle or flow through a fluid conduit or fluid chamber. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a firing chamber. In addition, a nozzle can include an orifice through which fluid is dispensed, a fluidic actuator, and a sensor. Each fluid chamber provides the fluid to be dispensed by the respective nozzle. Prior to a droplet release, the fluid in the fluid chamber is restrained from exiting the nozzle due to capillary forces and/or back-pressure acting on the fluid within the nozzle passage.

During a droplet release from a nozzle, the fluid within the fluid chamber is forced out of the nozzle by actively increasing the pressure within the fluid chamber. In some example fluid dispensing devices, a resistive heater positioned within the fluid chamber when activated vaporizes a small amount of at least one component of the fluid. In some cases, a major component of the fluid (such as liquid ink for printing systems or other types of fluids) is water, and the resistive heater vaporizes the water. The vaporized fluid component expands to form a gaseous drive bubble within the fluid chamber. This expansion exceeds a restraining force on the fluid within the fluid chamber enough to expel a quantity of fluid (a single fluid droplet or multiple fluid droplets) out of the nozzle. Generally, after the release of fluid droplet, the pressure in the fluid chamber drops below the strength of the restraining force and the remainder of the fluid is retained within the fluid chamber. Meanwhile, the drive bubble collapses and fluid from a reservoir for the fluid dispensing device flows into the fluid chamber to replenish the lost fluid volume resulting from the fluid droplet release. The foregoing process is repeated each time the nozzle of the fluid dispensing device is instructed to fire.

In other examples with non-ejecting fluidic actuators, the drive bubble formed by activation of a non-ejecting fluidic actuator causes movement of fluid through a fluid conduit or fluid chamber.

After repeated use of the fluidic actuators of a fluid dispensing device, the fluidic actuators or flow structures associated with the fluidic actuators may develop defects (e.g., a nozzle, fluid conduit, or fluid chamber may become clogged, a fluidic actuator may malfunction, etc.) and hence may not operate in a target manner. As a result, fluid dispensing performance of the fluidic actuators may degrade over time and use.

In some examples, fluidic actuator health can be determined by performing drive bubble detection (DBD) measurements for each fluidic actuator. DBD measurements can allow for detection of characteristics of a drive bubble and a fluid in a fluid chamber or fluid channel. From these characteristics, qualities of the drop ejected or fluid moved can be inferred, so that servicing or replacement of a degraded fluid dispensing device can be performed.

Although reference is made to DBD measurements in some examples, it is noted that techniques or mechanisms according to some implementations of the present disclosure can also be applied to other types of sense measurements of fluidic actuators. A sense measurement of a fluidic actuator refers to measuring a characteristic of the fluidic actuator and/or flow structure associated with the fluidic actuator for determining a condition of the fluidic actuator and/or flow structure.

A fire event can refer to a signal or other indication that is provided to activate a fluidic actuator. A fire event to activate a fluidic actuator can refer to a fire event to activate a single fluidic actuator or a group of fluidic actuators. In some examples, a DBD measurement for a fluidic actuator is performed in response to a fire event. In some cases, to obtain multiple DBD measurements for a fluidic actuator, the fluidic actuator can be fired multiple times in response to respective multiple fire events.

In some examples, activating a fluidic actuator to perform a DBD measurement can cause ejection of a fluid droplet from a corresponding nozzle or cause other dispensing of an amount of fluid, which can lead to increased fluid usage. Also, in printing applications, ejection of a fluid droplet during a sense measurement can lead to the fluid droplet being deposited onto a print medium or other print target, which may be undesirable since the fluid droplet can cause a noticeable artifact on the print medium or other print target.

In some implementations, to assess a health of a fluidic actuator, measurements under different conditions can be acquired. For example, the measurements under different conditions can include a "peak" measurement and a "reference" measurement. A peak measurement is a measurement acquired when a drive bubble produced by activation of a respective fluidic actuator is at its peak or when the drive bubble is expected to be at its peak. The drive bubble being at its peak can refer to a condition of the drive bubble when the drive bubble has its largest extent in a fluid chamber in response to activation of the respective fluidic actuator. At a later time, when the drive bubble has collapsed in the nozzle, another measurement can be acquired, which is referred to as a reference measurement. The peak measurement and the reference measurement can be used to assess the health of the nozzle.

More generally, an activated sense measurement (e.g., a peak measurement) can be performed under a first condition of a fluidic actuator in response to activation of the fluidic actuator, and a reference measurement can be performed under a different second condition when the fluidic actuator remains inactive.

In some cases, it may be desirable for the reference measurement to be performed relatively close in time to the activated sense measurement. Waiting too long for the reference measurement following the activated sense measurement may produce sub-optimal results.

In accordance with some implementations of the present disclosure, extra ejection or flow of fluid from nozzles or other flow structures subject to activated sense measurements (e.g., DBD peak measurements) can be suppressed by providing circuitry as part of a fluid dispensing device (e.g., a fluidic die) to detect that a given fluidic actuator is to be activated and detect that an activated sense measurement is to be performed in a first time group. In addition, the fluid dispensing device further includes circuitry to perform a reference measurement in a second time group that directly follows the first time group in which the activated sense measurement is performed. This allows the activated sense measurement and the reference measurement for the same fluidic actuator to be taken autonomously (without additional instruction from a system controller) by the fluid dispensing device relatively close in time to one another to achieve more accurate results.

In the ensuing discussion, reference is made to peak measurements and reference measurements of fluidic actuators. It is noted that in other examples, instead of peak measurements, other types of activated sense measurements can be performed for fluidic actuators that are activated.

A "time group" refers to a collection of activation intervals for controlling activation of respective fluidic actuators in a group of fluidic actuators. In the ensuing discussion, a "time group" can also be referred to as a "column group," and a group of fluidic actuators can be referred to as a "primitive" that includes multiple fluidic actuators to be selected by respective different addresses.

In some examples, the second time group in which the reference measurement is taken directly following the first time group in which the peak measurement is taken can be a time group that is adjacent to the first time group—in other words, no other time group is between the first time group and the second time group. In other examples, the second time group can follow the first time group, with a specified number (one or greater than one) of time groups intervening between the first time group and the second time group. This specified number of intervening time groups between the first and second time groups can be any number considered to allow the peak and reference measurements of a given fluidic actuator to be sufficiently close in time to one another to achieve target results.

FIG. 1 is a block diagram of a fluid dispensing system 100, according to some examples. The fluid dispending system 100 can be a printing system, such as a 2D printing system or a 3D printing system. In other examples, the fluid dispending system 100 can be a different type of fluid dispensing system. Examples of other types of fluid dispensing systems include those used in fluid sensing systems, medical systems, vehicles, fluid flow control systems, and so forth.

The fluid dispensing system 100 includes a fluid dispensing device 102 for dispensing fluid. In a 2D printing system, the fluid dispensing device 102 includes a printhead that ejects printing fluid (e.g., ink) onto a print medium, such as a paper medium, a plastic medium, and so forth.

In a 3D printing system, the fluid dispensing device 102 includes a printhead that can eject any of various different printing fluids onto a print target, where the printing fluids can include any or some combination of the following: ink, an agent used to fuse powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

In some examples, the fluid dispensing device 102 can be a fluid dispensing die. A "die" refers to an assembly where various layers are formed onto a substrate to fabricate circuitry, fluid chambers, and fluid conduits.

The fluid dispensing device 102 includes an array of fluidic actuators 104. The array of fluidic actuators 104 can include a column of fluidic actuators, or multiple columns of fluidic actuators. The fluidic actuators 104 can be organized into multiple primitives, where each primitive includes a specified number of fluidic actuators. FIG. 1 shows primitives P0 and P1. Each primitive P0 or P1 includes 8 fluidic actuators. In other examples, a primitive can include a different number of fluidic actuators. Also, the array of fluidic actuators 104 can include more than two primitives.

The fluidic actuators 104 can be part of nozzles or can be associated with other types of flow structures, such as fluid conduits, fluid chambers, and so forth. Each fluidic actuator is selected by a respective different address. Thus, in the example of FIG. 1, the fluidic actuators in the nozzles of the primitive P0 are selected by respective addresses A0-A7, and similarly, the fluidic actuators in the nozzles of the primitive P1 are selected by respective addresses A0-A7.

In some examples, fluidic and electrical constraints can prevent firing of all of the fluidic actuators 104 simultaneously. To fire all the fluidic actuators, data (e.g., in the form of a first data packet) is loaded to activate all fluidic actuators in the primitives for a first address (e.g., A0), then data (e.g., in the form of a second data packet) is loaded to activate all fluidic actuators selected by a second address (e.g., A1), and so forth.

In some examples, fire data (also referred to as "activate data") to control activation or non-activation of a fluidic actuator in each primitive can be loaded in one of several ways. A first way is to load fire data (for activating a fluidic actuator) on a per-primitive basis, and a second way is to load fire data on a per-fluidic actuator basis. In some examples, loading the fire data on a per-primitive basis refers to loading fire data for each primitive and supplying an address for each primitive, where the fire data loaded for a respective primitive is used for activating just a single fluidic actuator of the respective primitive in each activation interval. More specifically, a unique fire data bit (or fire data bits) is loaded for each respective primitive, and a single address is supplied to groups of primitives. In each successive activation interval, fire data for a successively different fluidic actuator is loaded for each primitive. In some examples, the activation intervals are referred to as fire pulse groups (FPGs). A set of FPGs, including one FPG for each address, is referred to as a column group. The fire data loaded in each FPG (or more generally, each activation interval) can be in the form of a data packet.

More generally, a column group is referred to as a group of activation intervals that correspond to different addresses (e.g., A0-A7). In the example of FIG. 1, the 8 fluidic actuators of each primitive can be activated in the respective 8 FPGs of a column group (or more generally, the respective 8 activation cycles of a group of activation cycles).

In some examples, the loading of fire data on a per-primitive basis is performed in a fluid dispensing device that has an FPG arrangement, i.e., an arrangement where for each primitive, successive fluidic actuators of a primitive are activated in respective activation intervals with fire data loaded in each respective activation interval.

As noted above, another way of loading fire data is to load fire data on a per-fluidic actuator basis. In some examples, loading fire data on a per-fluidic actuator basis is performed for a fluid dispensing device that has a full column buffer (FCB) arrangement. In the FCB arrangement, fire data is loaded for all fluidic actuators in an array of fluidic actuators (e.g., column of fluidic actuators). As a result, fire data does not have to be loaded on each successive activation interval of multiple activation intervals for activating fluidic actuators of a primitive. Rather, since the fire data has been loaded for all fluidic actuators of the array of fluidic actuators, such loaded fire data for the individual fluidic actuators can be used to control activation of respective fluidic actuators. Once fire data has been loaded for all fluidic actuators, fire pulses and address data are provided to all primitives (i.e., for an 8-address primitive, 8 fire pulses, each with a unique address, are sent before the next FCB data packet is loaded).

In accordance with some implementations of the present disclosure, as shown in FIG. 1, the fluid dispensing device 102 further includes a DBD controller 120 and a decoder 122 that is used to control activation of fluidic actuators 104, where the activation of a fluid actuator can be a normal activation of the fluid actuator, or a sense measurement activation of the fluid actuator to perform an activated sense measurement (e.g., a peak measurement).

As used here, a "controller" can refer to a hardware processing circuit or a combination of a hardware processing circuit and machine-readable instructions executable on the hardware processing circuit. A hardware processing circuit can include any or some combination of the following: a microprocessor, a core of a multi-core microprocessor, a microcontroller, a programmable integrated circuit, a programmable gate array, or another hardware processing circuit.

The decoder 122 can also refer to a hardware processing circuit or a combination of a hardware processing circuit and machine-readable instructions executable on the hardware processing circuit.

A "normal activation" of a fluidic actuator refers to activating the fluidic actuator in a scheduled activation interval, as scheduled by a system controller 110 of the fluid dispensing system 100. A "sense measurement" activation of a fluidic actuator refers to activating the fluidic actuator in a sense measurement interval that is shifted in time from a scheduled activation interval (also referred to as a "normal activation interval").

The DBD controller 120 provides control signals 124 to control the operation of the decoder 122. Further details regarding the control signals 124 are provided below. The DBD controller 120 also provides timing signals 126 to a DBD circuit 106.

The DBD circuit 106 can receive a DBD measurement signal 107 output by a sensor (that is associated with an activated fluidic actuator) of a nozzle (or other flow structure) that is subjected to a DBD measurement (peak measurement or reference measurement). In examples where the fluid dispensing device 102 includes nozzles, the nozzles can include respective sensors. In other examples, the sensors can be included in other flow structures through which fluid can be dispensed by activations of respective fluidic actuators.

A sensor includes a fluid property sensor to measure a fluid property of the nozzle or other flow structure. The sensor can measure a fluid property concurrent with activation of an associated fluidic actuator. In examples where a fluidic actuator is a thermal based fluidic actuator, the sensor can be used (via sense circuits) to sense a fluid property during formation and collapse of a vapor bubble.

In other examples where the fluidic actuator is a piezoelectric membrane based fluidic actuator, the sensor may be used (via sense circuits) to sense a fluid property during actuation of the piezoelectric membrane that causes ejection or other movement of a quantity of fluid.

In some examples, a sensor can include an impedance sensor to measure variations in the impedance associated with a nozzle or other flow structure due to formation of a drive bubble. In other examples, other types of sensors can be used to measure characteristics of the nozzle or other flow structure due to formation of a drive bubble.

In an example, if a first fluidic actuator of the primitive P0 (which can be any of the fluidic actuators selected by addresses A0-A7) is the subject of a DBD measurement (e.g., a peak measurement or a reference measurement), then the DBD circuit 106 receives the DBD measurement signal 107 from the sensor associated with the first fluidic actuator of the primitive P0. Similarly, if a second fluidic actuator of the primitive P1 (which can be any of the fluidic actuators selected by addresses A0-A7) is the subject of a DBD measurement, then the DBD circuit 106 receives the DBD measurement signal 107 from the sensor associated with the second fluidic actuator in the primitive P1.

In some examples, just one fluidic actuator is selected per array of fluidic actuators 104 for performing a DBD measurement. In other examples, more than one fluidic actuator can be selected for DBD measurement in an array of fluidic actuators 104.

The DBD circuit 106 includes a storage 108 to store a value corresponding to the DBD measurement signal 107 received from the sensor associated with the fluidic actuator that is subject to the DBD measurement. The storage 108 can be a memory, a storage capacitor, a latch, a register, or any other type of storage element.

The storage 108 can store an analog signal corresponding to the DBD measurement signal 107, or a digital value based on the DBD measurement signal 107. To produce a digital value, for example, the DBD circuit 106 can include a comparator (not shown) to compare the DBD measurement signal 107 from a sensor of a nozzle that is the subject of a DBD measurement, to a specified threshold. The output of the comparator can then be provided to an analog-to-digital (ADC) converter to convert into a digital value that can be stored in the storage 108. In other examples, other ways of producing a digital value based on the DBD measurement signal 107 can be performed.

The timing at which the DBD measurement signal 106 is processed and stored by the DBD circuit 106 is controlled by the timing signals 126 from the DBD controller 120.

The fluid dispensing system 100 also includes the system controller 110 (which is separate from the fluid dispensing device 102) that can control the operation of the fluidic actuators 104 of the fluid dispensing device 102.

The system controller 110 receives fluid control data 114, which controls (schedules) which of the fluidic actuators of the array of fluidic actuators 104 of the fluid dispensing device 102 are to be activated (and which other fluidic actuators are to remain inactive). In a printing system, the fluid control data 114 includes image data that schedules the dispensing of fluid from nozzles in forming an image on a print medium (for 2D printing) or in forming a 3D object (for 3D printing) during a print operation. Alternatively, the fluid control data 114 can schedule the activation of pumps or other fluidic actuators to cause flow of a fluid, such as to distribute pigment particles and so forth.

The system controller 110 provides controller activation data 111 (which may include fire data and address data, among other things like DBD control data) to the fluid dispensing device 102. A data controller (not shown) on the fluid dispensing device 102 processes the received controller activation data 111 and extracts fire data 128 and address signals 130 that are provided to various groups of primitives, to select and control activation of the fluidic actuators 104 in respective activation intervals. In addition, the DBD controller 120 can extract sense measurement select data (e.g., DBD select data) from the DBD control data in the controller activation data 111.

Figure 2:
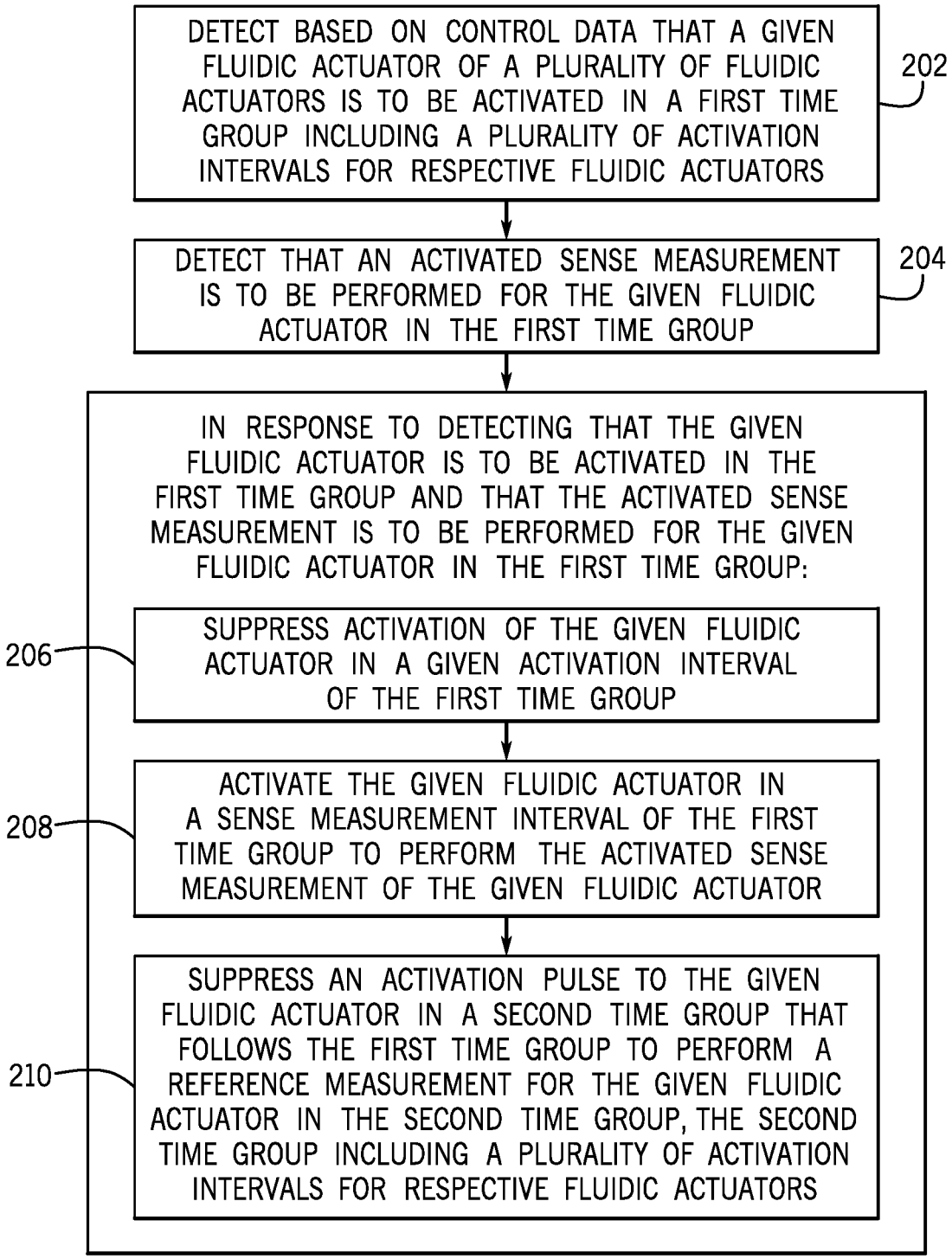
FIG. 2 is a flow diagram of a process of a decoder according to some examples.

FIG. 2 is a flow diagram of a process of the decoder 122 according to some examples. The decoder 122 detects (at 202) based on control data (e.g., fire data 128) that a given fluidic actuator of a plurality of fluidic actuators is to be activated in a first time group including a plurality of activation intervals for respective fluidic actuators.

The decoder 122 detects (at 204) that an activated sense measurement (e.g., a peak measurement) is to be performed for the given fluidic actuator in the first time group. This detection can be based on sense measurement select data that is part of the control signals 124 from the DBD controller 120 of the fluid dispensing device 102.

In response to detecting that the given fluidic actuator is to be activated in the first time group and that the activated sense measurement is to be performed for the given fluidic actuator in the first time group, the decoder 122 suppresses (at 206) activation of the given fluidic actuator in a given activation interval of the first time group, activates (at 208) the given fluidic actuator in a sense measurement interval of the first time group to perform the activated sense measurement of the given fluidic actuator, and suppresses (at 210) an activation pulse to the given fluidic actuator in a second time group that follows the first time group to perform a reference measurement for the given fluidic actuator in the second time group, the second time group including a plurality of activation intervals for respective fluidic actuators.

Figure 3:
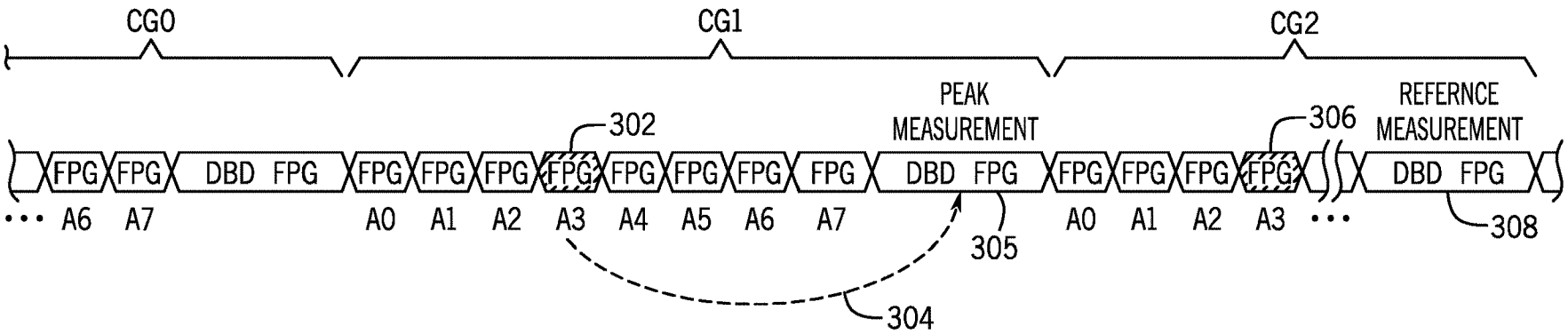
FIG. 3 is a timing diagram illustrating groups of activation intervals, with each group of activation intervals including a sense measurement interval according some examples.

FIG. 3 is a timing diagram that shows multiple column groups CG0, CG1, and CG2. As noted above, each column group includes a sequence of FPGs (assuming that the fluid dispensing device 102 has an FPG arrangement). The sequence of FPGs in a column group includes multiple FPGs that corresponding to respective addresses A0-A7. Such FPGs can be referred to as "normal FPGs" since respective fluidic actuators are selected for activation based on the fluid control data 114 in these FPGs. The series of FPGs in each column group further includes a DBD FPG, which is used to activate a fluidic actuator that is the subject of a peak measurement. Alternatively, a reference measurement can be performed in the DBD FPG (a fluidic actuator is not activated during the DBD FPG for the reference measurement). The DBD FPG is an extra FPG added to a column group in addition to the normal FPGs that correspond to addresses A0-A7.

If the fluid dispensing device 102 has an FCB arrangement, then the timing diagram of FIG. 3 can be modified to show each column group as having a sequence of activation intervals.

Primitive data (also referred to as "fire data") to control activation or non-activation of fluidic actuators is provided in each FPG to each primitive of the multiple primitives. The address sent with a FPG determines which fluidic actuator in each primitive is conditionally fired depending on the state of that primitive's fire data. So if, for example, the fluid control data 114 specifies that the fluidic actuator corresponding to address A3 in primitive P2 is to be fired, then during FPG 302 (corresponding to address A3), the fire data for primitive P2 is set active to enable activation of the fluidic actuator corresponding to address A3 in primitive P2.

Generally, a fluidic actuator activates if a) the fluidic actuator's fire data is set active, and b) if the current address matches that of the fluidic actuator's assigned address. A given fluidic actuator in a particular primitive is not activated, if in a current FPG of a column group, either the fire data for the particular primitive is set inactive or a current address for the current FPG does not match the address of the given fluidic actuator.

Although FIG. 3 shows a DBD FPG as having a length larger than that of a normal FPG, it is noted that the longer depicted length of the DBD FPG is used to represent the fact that a peak measurement process activates a fluidic actuator, waits a specified amount of time, and samples a measurement signal from the sensor associated with the fluidic actuator. In actuality, the DBD FPG may have a time length that is the same as or similar to the time length of a normal FPG.

Also, although FIG. 3 shows the DBD FPG as being at the end of the group of FPGs of each column group, it is noted that the DBD FPG can be provided at a different point relative to the normal FPGs of the column group. For example, the DBD FPG can be provided before the normal FPGs in each column group, or can be provided at any point between the normal FPGs.

In the example of FIG. 3, it is assumed that the fluid control data 114 has selected a fluidic actuator in a particular primitive (hereinafter referred to as the "selected fluidic actuator") corresponding to normal FPG 302 (address A3) in the column group CG1 for activation, and further, that the DBD controller 120 has decided (such as in response to a command from the system controller 110) to perform a peak measurement of the selected fluidic actuator in the column group CG1. This selected fluidic actuator is also referred to as the A3 selected fluidic actuator, since the fluidic actuator is in the particular primitive (fire data for the particular primitive is set active) and is to be activated by address A3 in the corresponding normal FPG 302.

In a normal operation (i.e., an operation where DBD measurement is not being performed for the column group CG1), the A3 selected fluidic actuator in the column group CG1 would be actuated in the normal FPG 302. However, in accordance with some implementations of the present disclosure, instead of activating the A3 selected fluidic actuator in the normal FPG 302, the selected fluidic actuator is instead activated in the DBD FPG 305 of the column group CG1 to perform a peak measurement. Effectively, the activation of the selected fluidic actuator has been time shifted (as indicated by 304) from the normal FPG 302 (which is the FPG when the selected fluidic actuator would normally be activated) to the DBD FPG 305 of the column group CG1.

The shifting (304) of the activation of the selected fluidic actuator is performed by a) suppressing activation of the selected fluidic actuator in the normal FPG 302, which is accomplished by the decoder 122 disabling the selected fluidic actuator in the normal FPG 302 (described in further detail in connection with FIG. 4 below), and b) the decoder 122 enabling activation of the selected fluidic actuator in the DBD FPG 305 of the column group CG1 (described in further detail in connection with FIG. 4 below).

In FIG. 3, the shifting (304) of the activation of the selected fluidic actuator for the peak measurement delays the activation of the selected fluidic actuator. In other examples, if the DBD FPG is placed earlier in the series of FPGs of the column group CG1 than the normal FPG 302, then the shifting (304) causes an earlier activation of the selected fluidic actuator to perform the peak measurement.

In accordance with some implementations of the present disclosure, a selected fluidic actuator that is to be subject to a peak measurement is chosen to be one that is already scheduled to fire in one of the normal FPGs corresponding to addresses A0-A7. However, by shifting the activation of the selected fluidic actuator, the selected fluidic actuator is not activated in the corresponding normal FPG, but instead is re-scheduled to be activated in the DBD FPG. Note that the selected fluidic actuator is still activated in the same column group that the selected fluidic actuator is set to be fired based on the fluid control data 114. The activation of the selected fluidic actuator is merely shifted by some amount of time relative to when the selected fluidic actuator was originally scheduled to be activated.

As discussed above, after performing a peak measurement in a first time group (e.g., column group CG1 in FIG. 3), the decoder 122 controls the fluid dispensing device 102 to perform a reference measurement in a second time group (e.g., column group CG2) directly following the first time group. In the example of FIG. 3, it is assumed that the fluid control data 114 has scheduled the fluidic actuator corresponding to address A3 to be fired during column group CG2. This corresponds to normal FPG 306 in column group CG2. Thus, during normal FPG 306 in column group CG2, the fire data for the respective fluidic actuator is set active to enable activation of the fluidic actuator corresponding to address A3 in column group CG2.

However, in accordance with some implementations of the present disclosure, the fluidic actuator corresponding to address A3 in column group CG2 is not activated during normal FPG 306. Activation of the A3 selected fluidic actuator during the normal FPG 306 in column group CG2 is suppressed.

Instead of activating the A3 selected fluidic actuator in normal FPG 306 in column group CG2, a reference measurement is instead performed in DBD FPG 308 of column group CG2 for the selected fluidic actuator. Note that the activation pulse to the selected fluidic actuator is suppressed in DBD FPG 308, so that the selected fluid actuator is not actually activated during DBD FPG 308. This allows the reference measurement to be performed without activation of the selected fluidic actuator.

Figure 4:
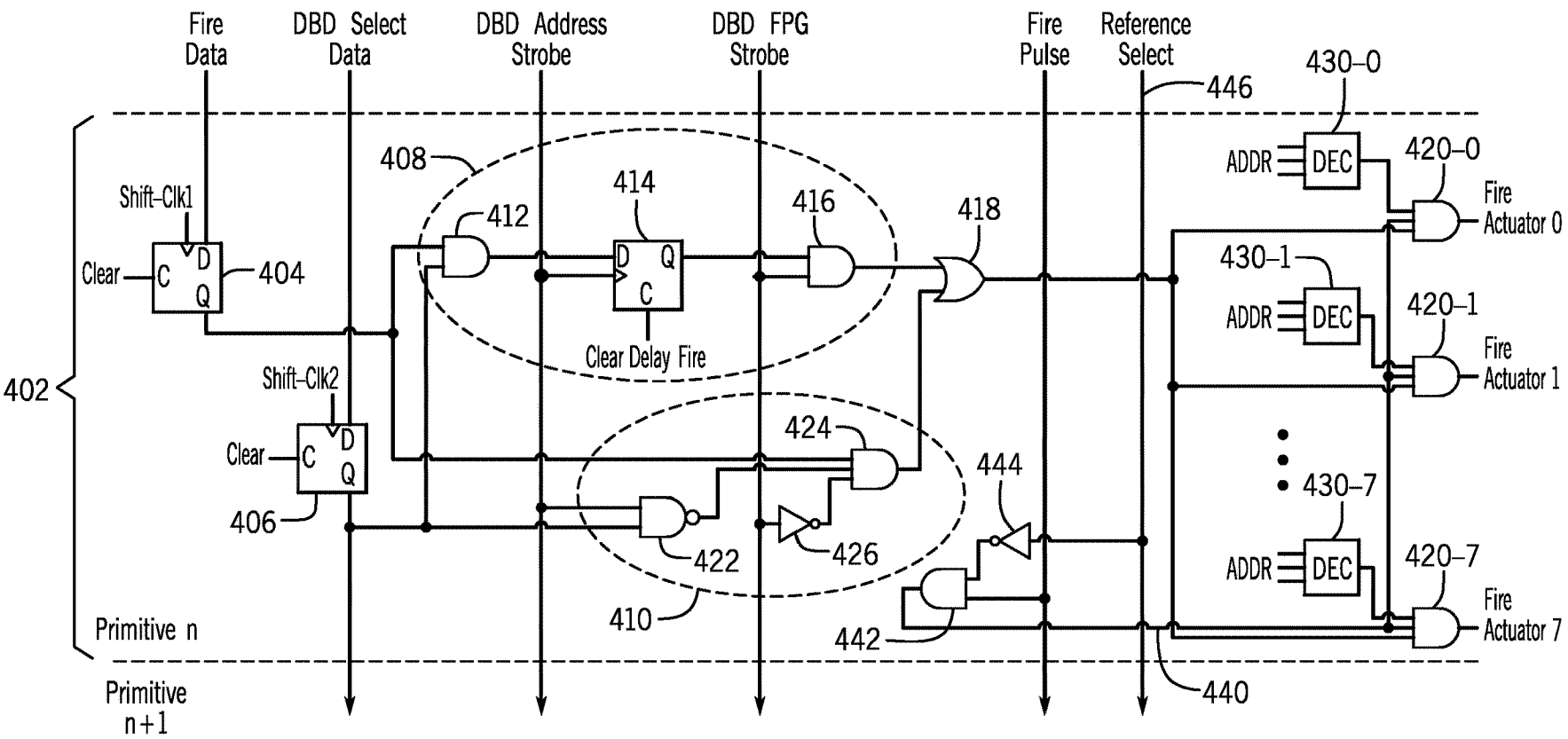
FIG. 4 is a schematic diagram of a decoder according to further examples.

FIG. 4 is a block diagram of components of an example of the decoder 122 according to the FPG arrangement noted above. Although specific gates (in the form of AND, OR, and NAND gates, inverters, and flip-flops) are shown implementing the decoder 122, it is noted that in other examples, similar logic can be implemented with other types of circuitry, such as an ASIC, PGA, and so forth. More generally, a "logic gate" as used herein can refer to an individual gate (e.g., an AND gate, an OR gate, an inverter, a NAND gate, etc.) or a combination of gates or any other circuitry used to implement a logic functionality.

A portion 402 of the decoder 122 controls activation of fluidic actuators of an individual primitive (primitive n) of the fluid dispensing device 102. The same decoder portion 402 is repeated for each of the other primitives of the fluid dispensing device 102.

The decoder portion 402 includes a storage element 404 to store the fire data for a fluidic actuator of primitive n. In some examples, the storage element 404 can be in the form of a flip-flop (referred to as a "fire data flip-flop"), which stores data received at the D input on a transition of a clock (Shift-Clk1) that is provided to a clock input of the fire data flip-flop 404. A Clear signal is connected to a C input of the fire data flip-flop 404, and is used to clear the flip-flop 404 to an initial state (e.g., 0), and the output of the flip-flop 404 is represented as a Q output. The Shift-Clk1 and Clear signals are part of the control signals 124 from the DBD controller 120 of FIG. 1. The Clear signal can be activated by the DBD controller 120 to clear fire data from the fire data flip-flops 404. In other examples, the Clear signal can be omitted if the DBD controller 120 loads all flip-flops 404 before any activation.

In some examples, the fire data flip-flop 404 stores one bit of data, which when set to "1" enables activation of a fluidic actuator of primitive n, and when set to "0" disables activation of a fluidic actuator in primitive n.

In other examples, the storage element 404 can be implemented with a different type of storage.

Although not shown, the fluid dispensing device 102 can include multiple levels of memory, including a higher-level memory and lower-level memory. The fire data to the storage element 404 is provided from the lower-level memory. Fire data in the higher-level memory can be loaded into the lower-level memory. Also, the fire data in the higher-level memory can be shifted down a shift chain of the higher-level memory elements as a clock (e.g., Shift-Clk1 or a different clock) cycles between active and inactive states. In other examples, multiple levels of memory to store fire data are not employed.

In the ensuing discussion, it is assumed that an active value of a signal or circuit node is logic "1", and that an inactive value of a signal or circuit node is logic "0". However, in different implements, an active value can correspond to logic "0", while an inactive value can correspond to logic "1".

In each activation interval (e.g., an FPG), fire data is loaded into the storage element 404 for an individual fluidic actuator of primitive n. In the FPG arrangement, fire data is loaded on a per-primitive basis. Although primitive n includes multiple fluidic actuators (e.g., 8 fluidic actuators), the storage element 404 for primitive n stores the fire data for just one fluidic actuator, i.e., the fluidic actuator that is to be controlled for activation in the current FPG. New fire data is loaded into the storage element 404 for primitive n on each successive FPG.

The decoder portion 402 for primitive n also includes another storage element 406 to store DBD select data, which can be used to select whether or not a fluidic actuator of primitive n is to be subject to a DBD peak measurement. The DBD select data can be provided by the system controller 110 or by the DBD controller 120.

In some examples, the storage element 406 can be implemented as a flip-flop (referred to as "DBD select data flip-flop"), which has a D input to receive the DBD select data, a clock input to receive Shift-Clk2 (which is part of the control signals 124 from the DBD controller 120 of FIG. 1), and a C input to receive a Clear signal. The DBD select data flip-flop 406 has a Q output. In other examples, the Clear signal can be omitted if the DBD controller 120 loads all flip-flops 406 before any activation.

In the FPG arrangement, a DBD select data for an individual fluidic actuator is loaded on a per-primitive basis, similar to the loading of the fire data. Thus, for each primitive, there is just one DBD select data flip-flop 406. In some examples, the DBD select data is shifted along a series of DBD select data flip-flops 406 by the cycling of Shift-Clk2.

More generally, a value stored by the storage element 406 is an example of a sense measurement indicator that can be set to a value specifying that a peak measurement is to be performed for a given primitive (FPG arrangement) or a given individual fluidic actuator (FCB arrangement).

The decoder portion 402 includes a DBD activate control logic 408 and a normal activate control logic 410. The DBD activate control logic 408 controls the activation of a fluidic actuator of primitive n that is to be subjected to a DBD peak measurement. The normal activate control logic 410 controls activation of a fluidic actuator of primitive n for the fluidic actuator that is not subjected to DBD measurement (peak measurement or reference measurement).

The DBD activate control logic 408 includes an AND gate 412 that receives as inputs the output of the storage element 404 and the output of the storage element 406. If both the fire data and the DBD select data are set to an active value (e.g., "1"), then the AND gate 412 outputs an active value that indicates that the corresponding fluidic actuator of primitive n is to be subjected to a DBD peak measurement. The output of the AND gate 412 is stored into a storage element 414 (e.g., implemented with a flip-flop) upon activation of a DBD Address Strobe provided to the clock input of the flip-flop 414. The output of the AND gate 412 being active indicates that the fluidic actuator selected by a current address (within primitive n) is scheduled to be activated based on the fluid control data 114, and that the primitive is selected for measurement.

The DBD Address Strobe is pulsed active for an address that selects a fluidic actuator that is to be subjected to a DBD peak measurement. The DBD Address Strobe is part of the control signals 124 provided by the DBD controller 120 of FIG. 1. More generally, a "sense address strobe" is pulsed active for an address that selects a fluidic actuator that is to be subjected to a peak measurement.

The flip-flop 414 is referred to as a DBD control flip-flop, and has a D input that receives the output of the AND gate 412, a clock input that receives the DBD Address Strobe, a C input that receives a Clear Delay Fire signal (also part of the control signals 124 from the DBD controller 120 of FIG. 1), and a Q output. The DBD control flip-flop 414 captures the state of the output of the AND gate 412 such that activation of the corresponding fluidic actuator that is to be subject to DBD peak measurement can be performed at the appropriate time (i.e., in the DBD FPG that is time shifted from the scheduled normal FPG). Effectively, the DBD control flip-flop 414 is set to an active value if a fluidic actuator in primitive n is selected for activation on the current address, and this fluidic actuator is selected for DBD peak measurement.

The Q output of the DBD control flip-flop 414 is provided to one input of an AND gate 416, and the other input of the AND gate 416 receives a DBD FPG Strobe. The DBD FPG Strobe is pulsed active during the DBD FPG depicted in FIG. 3. The DBD FPG Strobe is part of the control signals 124 provided by the DBD controller 120 of FIG. 1.

If both the inputs of the AND gate 416 are active (e.g., "1"), then the AND gate 416 outputs an active value to an input of an OR gate 418. Effectively, the AND gate 416 outputs an active value if the selected fluidic actuator (for the current address) is to be subjected to DBD peak measurement.

The other input of the OR gate 418 receives the output of the normal activate control logic 410. The OR gate 418 outputs an active value in response to either the DBD activate control logic 408 outputting an active value or the normal activate control logic 410 outputting an active value.

The output of the OR gate 418 is referred to as Qualified Fire Data, which is provided to inputs of fire AND gates 420-0, 420-1, . . . , 420-7, assuming an example where each primitive includes 8 fluidic actuators.

In the normal activate control logic 410, a NAND gate 422 receives as inputs the DBD Address Strobe and the Q output of the DBD select data flip-flop 406.

The DBD Address Strobe is pulsed active for an address that selects a fluidic actuator that is to be subjected to a peak measurement. Thus, if the DBD select data is set to an active value, and the DBD Address Strobe is pulsed active, the NAND gate 422 outputs an inactive value (e.g., "0"), which disables an AND gate 424 of the normal activate control logic 410 from activating its output. As a result, if a fluidic actuator of primitive n selected by a current address is to be subject to a peak measurement, the normal activate control logic 410 suppresses the activation of the fluidic actuator during the normal FPG, which allows the activation of the fluidic actuator to be activated in the DBD FPG by the DBD activate control logic 408.

On the other hand, if the DBD Select Data is set to an inactive value, or the DBD Address Strobe is not set to an active value, then the NAND gate 422 outputs an active value, which allows the AND gate 424 to output an active value if the fire data flip-flop 404 storing the fire data has an active value and the DBD FPG Strobe is not active, as detected by another input of the AND gate 424 through an inverter 426.

The AND gate 424 outputting an active value enables the activation of the fluidic actuator selected by the current address in a normal FPG.

The fire AND gates 420-0 to 420-7 also receive a Primitive Fire signal 440 that is output by a fire pulse enable AND gate 442. The fire AND gates 420-0 to 420-7 also receive outputs of respective address decoders 430-0 to 430-7.

The inputs of the fire pulse enable AND gate 442 receive a Fire Pulse and an inverted version (as inverted by an inverter 444) of a Reference Select signal 446. The Fire Pulse is generated by the system controller 110 or the DBD controller 120, or another controller (whether as part of the fluid dispensing device 102 or off the fluid dispensing device 102), and controls when fluidic actuators are activated. The pulse width of the Fire Pulse also may control an amount of energy provided to an activated fluidic actuator.

The Reference Select signal 446 (which is part of the control signals 124 of FIG. 1) is set to an active value by the DBD controller 120 (FIG. 1) if a reference measurement is to be performed in a current column group. The DBD controller 120 can set the Reference Select signal 446 to the active value (e.g., "1") during a given column group (e.g., CG2 in FIG. 3) in response to a peak measurement taken in a previous column group (e.g., CG1 IN FIG. 3). Otherwise, the DBD controller 120 sets the Reference Select signal 446 to an inactive value (e.g., "0").

Note that if the Reference Select signal 446 is an active low signal, then the inverter 444 can be omitted.

The fire pulse enable AND gate 442 activates the Primitive Fire signal 440 in response to the Reference Select signal 446 being inactive and the Fire Pulse being active. However, if the Reference Select signal 446 is set active, then the fire pulse enable AND gate 442 is disabled and does not activate the Primitive Fire signal 440 even if Fire Pulse is activated.

Each address decoder **430-*i* (i=0 to 7) receives address signals (an example of 130 in FIG. 1), ADDR[m:0], where m≥1 and depends on the number of fluidic actuators in each primitive. For example, if there are 8 fluidic actuators per primitive, then m≥2. In some examples, the address decoder 430-0 outputs an active value if the address signals ADDR [2:0] have value 000 (referred to as "A0"), the address decoder 430-1 outputs an active value if the address signals ADDR[2:0] have value 001 (referred to as "A1"), address decoder 430-2 outputs an active value if the address signals ADDR[2:0] have value 010 (referred to as "A2**"), and so forth.

If all inputs of a fire AND gate **420-*i* (i=0 to 7) are set active, then the fire AND gate 420-*i*** activates its output Fire Actuator i signal, which is an activation signal to activate a corresponding fluidic actuator i of primitive n. If the Fire Actuator i signal is inactive, then the corresponding fluidic actuator i of primitive n remains inactive.

In operation, to control activation of fluidic actuators of each primitive, the system controller 110 provides addresses A0 to A7 in corresponding normal FPGs in a given sequence of column group CGi. If a given normal FPG x (having a corresponding given address Ax) is for a given fluidic actuator x that is selected for DBD peak measurement, then the DBD Address Strobe is activated in column group CGi, so that activation of the given fluidic actuator x in the given normal FPG x is suppressed in the normal activate control logic 410.

Once the sequence of normal FPGs for respective addresses A0 to A7 have been processed in column group CGi, the DBD controller 120 activates the DBD FPG Strobe for the DBD FPG. The DBD controller 120 also sets the address of the DBD FPG to the address Ax (which is the address of fluidic actuator x that has been selected for DBD peak measurement). Upon the activation of the Fire Pulse (and thus the Primitive Fire signal 440 since the Reference Select signal 446 is inactive for the column group in which the DBD peak measurement is performed), the fire AND gate **420-*x*** activates Fire Actuator x to activate the fluidic actuator x in the DBD FPG of the column group CGi.

In accordance with some implementations of the present disclosure, the DBD controller 120 controls the decoder 122 to cause the performance of a reference measurement in the next column group (CGi+1) following the column group (CGi) in which the DBD peak measurement was performed. In operation, to control activation of fluidic actuators in column group CGi+1, addresses A0 to A7 are provided by the system controller 110 in corresponding normal FPGs in the column group CGi+1. If the fire data for the fluidic actuator x that was subject to DBD peak measurement in the previous column group CGi is set active, the DBD Address Strobe is set active by the DBD controller 120 only during the appropriate normal FPG (corresponding to the address of the fluidic actuator subjected to the peak measurement) in column group CGi+1. It is noted that the DBD select data flip-flop 406 maintains the storing of an active value (i.e., the DBD select data flip-flop 406 was set active in column group CGi, and remains active in the following column group CGi+1). As a result, the NAND gate 422 in the normal activate control logic 410 disables the AND gate 424 of the normal activate control logic 410 from activating its output, to prevent fluidic actuator x from being activated in the normal FPG corresponding to Address x in column group CGi+1.

Note that the DBD select data flip-flop 406 maintains its stored data state of the DBD select data unless changed by the DBD controller 120 based on changing the DBD select data and the use of Shift-Clk2.

In the DBD FPG of column group CGi+1, the DBD controller 120 activates the Reference Select signal 446, which disables the fire pulse enable AND gate 442, to prevent activation of the fluidic actuators of primitive n in column group CGi+1. Thus, in the DBD FPG of column group CGi+1, a reference measurement can be taken of fluidic actuator x that was subject to the DBD peak measurement in the previous column group CGi.

Figure 5:
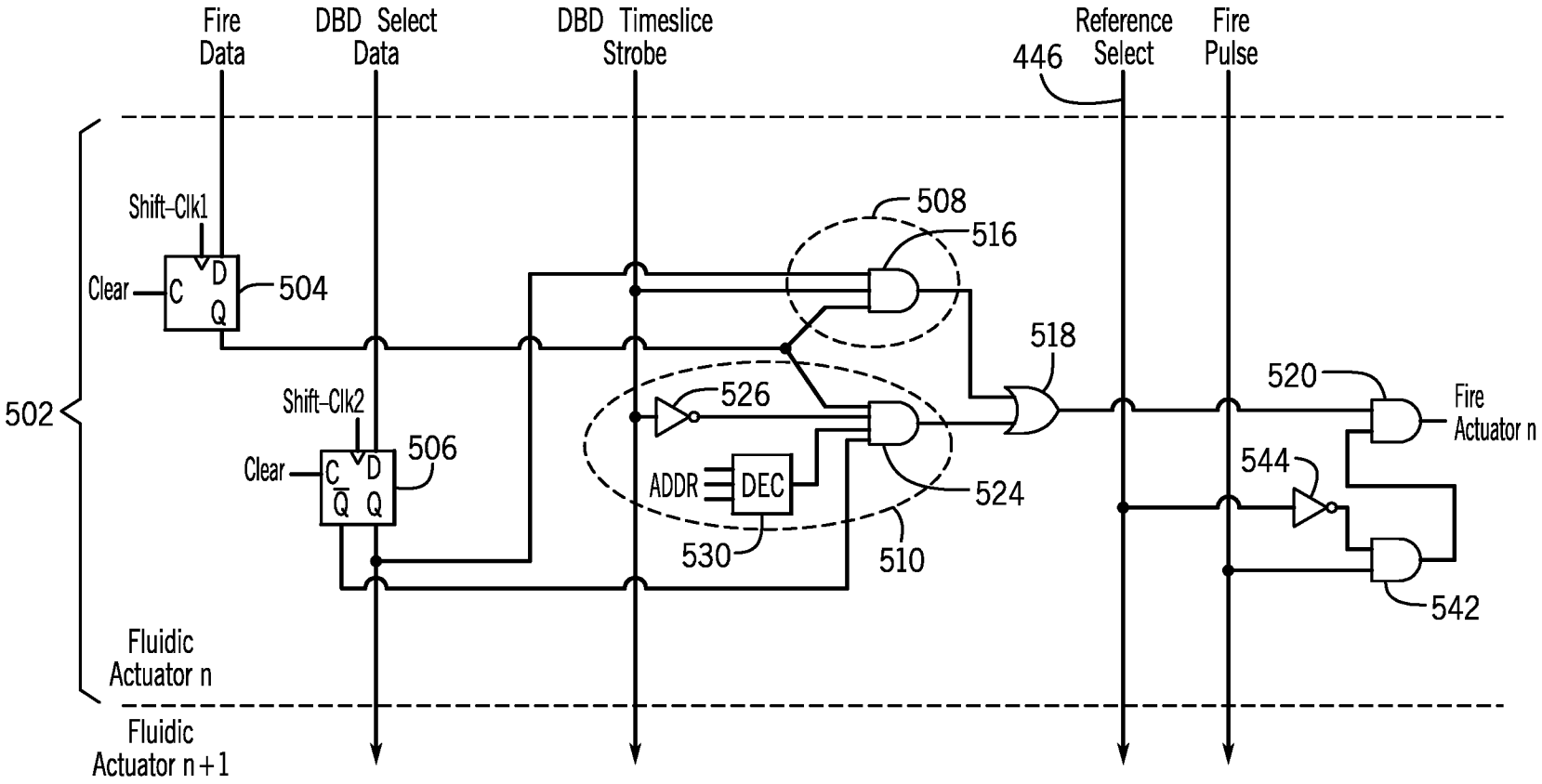
FIG. 5 is a schematic diagram of a decoder according to alternative examples.

FIG. 5 shows a portion 502 of the decoder 122 according to the FCB arrangement discussed above. The decoder portion 502 is for controlling activation of fluidic actuator n. The logic of the decoder portion 502 is repeated for each of the other fluidic actuators of an array (e.g., column) of fluidic actuators.

The decoder portion 502 includes a storage element 504 for storing the fire data for fluidic actuator n, and a storage element 506 for storing the DBD select data for fluidic actuator n. According to the FCB arrangement, a corresponding pair of the storage elements 504 and 506 is individually associated with each of the fluidic actuators of the array of fluidic actuators.

Similar to the arrangement of FIG. 4, each of the storage elements 504 and 506 can be implemented as a flip-flop.

In FIG. 5, both the non-inverting (Q) output and inverting ($\overline{Q}$) output of the DBD select data flip-flop 506 are shown. The non-inverting (Q) output of the DBD select data flip-flop 506 is provided to an input of an AND gate 516 of a DBD activate control logic 508 of the decoder portion 502. The DBD activate control logic 508 controls the activation of fluidic actuator n that is to be subjected to a DBD peak measurement.

The other inputs of the AND gate 516 of the DBD activate control logic 508 receive a DBD Timeslice Strobe (which is similar to the DBD FPG Strobe of FIG. 4) and the output of the fire data flip-flop 504. The DBD Timeslice Strobe is part of the control signals 124 from the DBD controller 120 of FIG. 1. The DBD Timeslice Strobe is set active during the DBD time interval of a column group.

Thus, if both the fire data and the DBD select data for fluidic actuator n are active, the AND gate 516 of the DBD activate control logic 508 sets its output active when the DBD Timeslice Strobe is activated during the DBD time interval. Activation of the output of the AND gate 516 causes an OR gate 518 to activate its output that is provided to an input of a fire AND gate 520 that outputs a Fire Actuator n signal for controlling the firing of fluidic actuator n.

The decoder portion 502 also includes a normal activate control logic 510 that controls activation of fluidic actuator n that is not subjected to DBD measurement.

The other input of the OR gate 518 is connected to the output of an AND gate 524 of the normal activate control logic 510. If either the AND gate 516 or the AND gate 524 activates its output, the OR gate 518 activates its output.

The inputs of the AND gate 524 of the normal activate control logic 510 are connected to the following: the output of the fire data flip-flop 504; the inverting ($\overline{Q}$) output of the DBD select data flip-flop 506; an inverted version (as inverted by an inverter 526) of the DBD Timeslice Strobe, and an output of an address decoder 530, which receives address lines ADDR (130 in FIG. 1).

The AND gate 524 of the normal activate control logic 510 is disabled from activating its output in response to either the DBD select data for fluidic actuator n being active (as stored by the DBD select data flip-flop 506), or the DBD Timeslice Strobe being active. Thus, the normal activate control logic 510 does not cause activation of fluidic actuator n if the DBD select data for fluidic actuator n is active, or during the DBD time interval (as indicated by the DBD Timeslice Strobe).

The address lines ADDR contain an address corresponding to fluidic actuator n, then the address decoder 530 activates its output to enable the AND gate 524 to activate its output if the fire data stored in the fire data flip-flop 504 is active, and the DBD select data flip-flop 506 stores an inactive value, and the fluid dispensing device 102 is not in a DBD time interval (i.e., DBD Timeslice Strobe is inactive).

The decoder portion 502 includes an inverter 544 and a fire pulse enable AND gate 542, which have similar functionality as the corresponding gates 444 and 442 of FIG. 4. If the Reference Select signal 446 is active, then the fire pulse enable AND gate 542 is disabled from activating its output in response to the Fire Pulse. However, if the Reference Select signal 446 is inactive, then the fire pulse enable AND gate 542 activates its output in response to activation of the Fire Pulse, to allow the fire AND gate 520 to activate the Fire Actuator n signal if the OR gate 518 outputs an active value.

Figure 6:
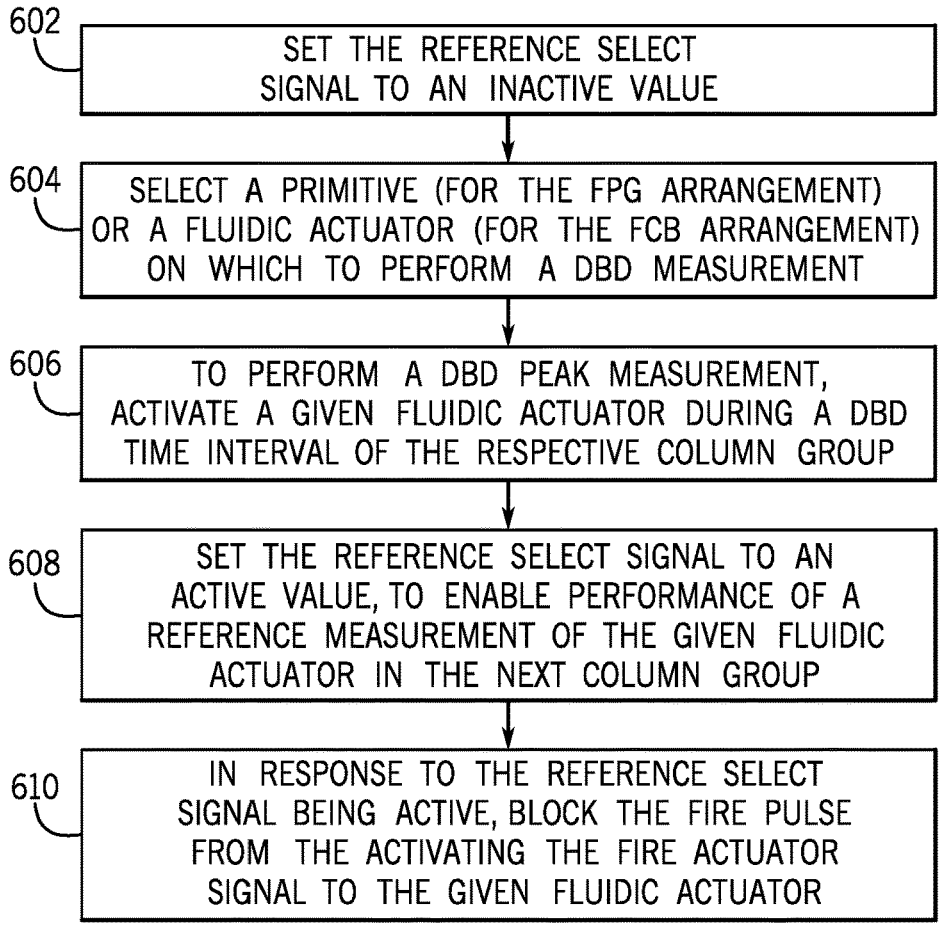
FIG. 6 is a flow diagram of a process according to additional examples.

FIG. 6 is a flow diagram of a process of performing a peak measurement and a reference measurement in successive time groups, according to some implementations. Initially, the DBD controller 120 sets (at 602) the Reference Select signal to an inactive value. The DBD controller 120 selects (at 604) a primitive (for the FPG arrangement) or a fluidic actuator (for the FCB arrangement) on which to perform a DBD peak measurement.

To perform a DBD peak measurement, the decoder 122 activates (at 606) a given fluidic actuator during a DBD time interval of the respective column group. The given fluidic actuator that is activated and on which the DBD peak measurement is performed is the fluidic actuator selected by a provided address (ADDR) and for which the decoder 122 has set fire data flip-flop (404 or 504) to the active value and set the DBD select data flip-flop (406 or 506) to the active value.

The DBD controller 120 next sets (at 608) the Reference Select signal to an active value, to enable performance of a reference measurement of the given fluidic actuator in the next column group. In response to the Reference Select signal being active, the decoder 122 blocks (at 610) the Fire Pulse from the activating the Fire Actuator signal to the given fluidic actuator. This blocking is performed by the logic gates 442 and 444 of FIG. 4, or the logic gates 552 and 554 of FIG. 5.

Figure 7:
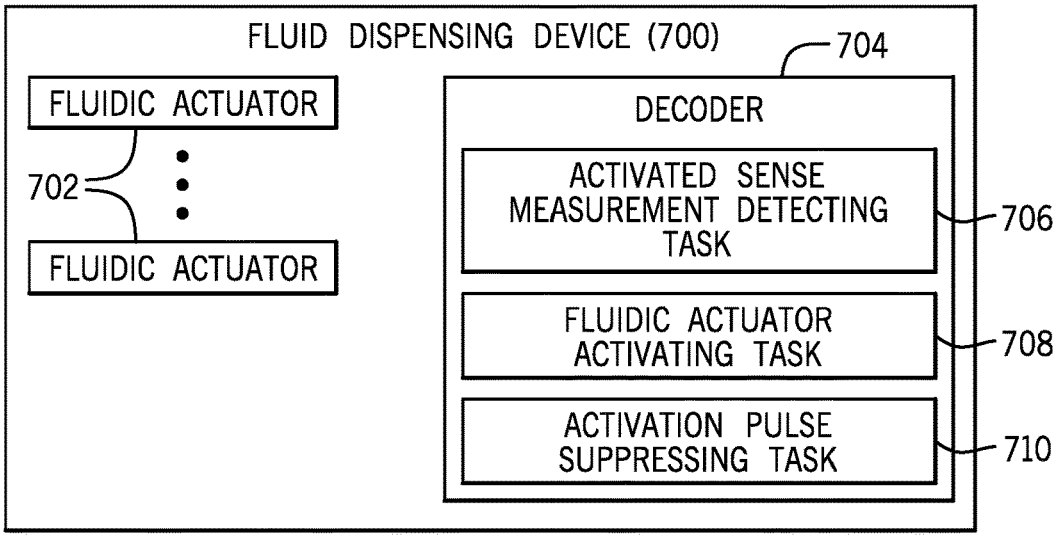
FIG. 7 is a block diagram of a fluid dispensing device according to further examples.

FIG. 7 is a block diagram of a fluid dispensing device 700 according to further examples. The fluid dispensing device 700 includes a plurality of fluidic actuators 702 and a decoder 704 to perform various tasks. The tasks performed by the decoder 704 include an activated sense measurement detecting task 706 to detect that an activated sense measurement is to be performed for a first fluidic actuator of the plurality of fluidic actuators in a first time group (e.g., column group) comprising a plurality of activation intervals for respective fluidic actuators.

The tasks further include a fluidic actuator activating task 708 and an activation pulse suppressing task 710 that are performed in response to detecting that the activated sense measurement is to be performed for the first fluidic actuator in the first time group. The fluidic actuator activating task 708 activates the first fluidic actuator in the first time group to perform the activated sense measurement for the first fluidic actuator.

The activation pulse suppressing task 710 suppresses an activation pulse to the first fluidic actuator in a second time group that follows the first time group to perform a reference measurement for the first fluidic actuator in the second time group, the second time group comprising a plurality of activation intervals for respective fluidic actuators.

Figure 8:
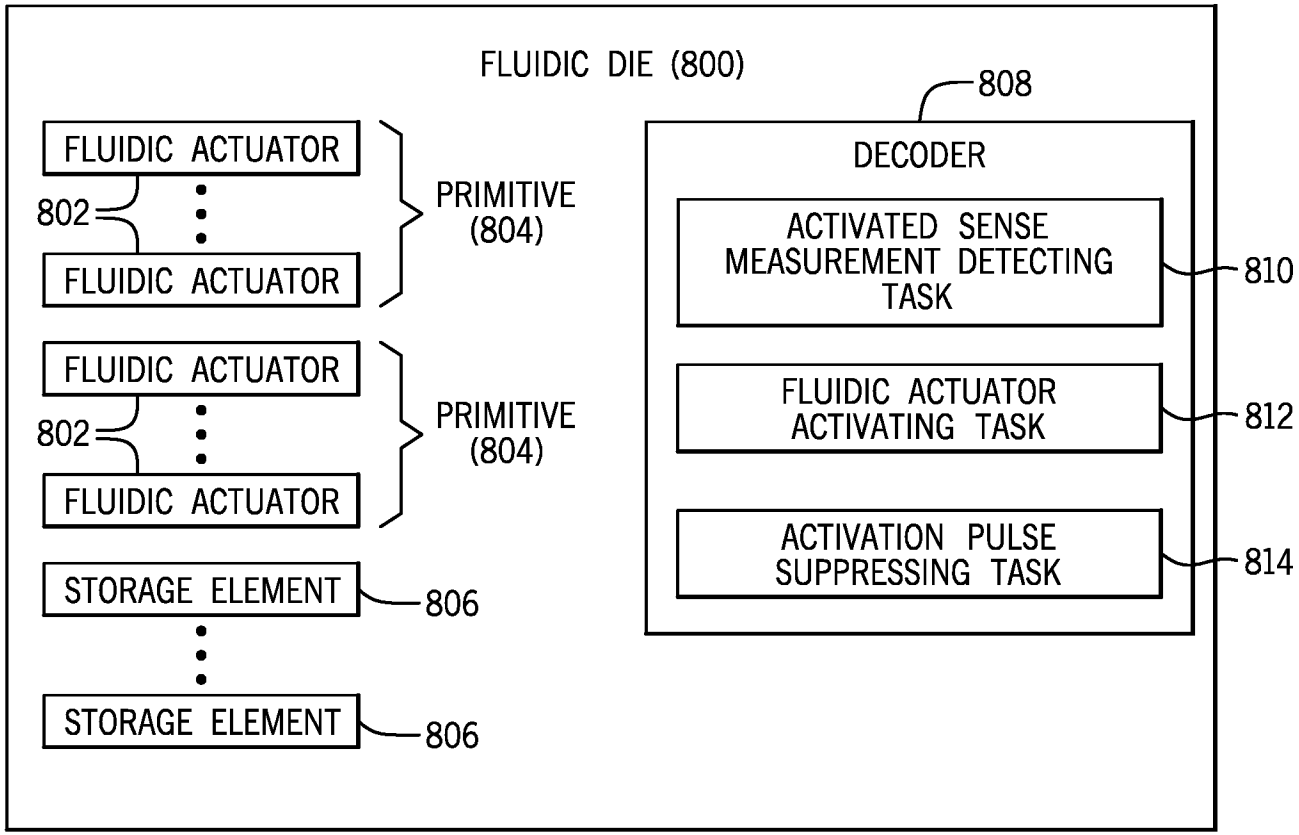
FIG. 8 is a block diagram of a fluidic die according to yet further examples.

FIG. 8 is a block diagram of a fluidic die 800 including a plurality of fluidic actuators 802 arranged as primitives 804 of fluidic actuators. The fluidic die 800 includes a plurality of storage elements 806 to store sense measurement indicators to indicate whether or not respective fluidic actuators or primitives are to be subject to an activated sense measurement. The fluidic die 800 additionally includes a decoder 808 to perform various tasks.

The tasks of the decoder 808 include an activated sense measurement detecting task 810 to detect, based on a sense measurement indicator in a storage element of the plurality of storage elements 806, that an activated sense measurement is to be performed for a first fluidic actuator of the plurality of fluidic actuators 802 in a first time group (e.g., column group) comprising a plurality of activation intervals for respective fluidic actuators. The decoder 808 performs a fluidic actuator activating task 812 and an activation pulse suppressing task 814 in response to detecting that the activated sense measurement is to be performed for the first fluidic actuator in the first time group. The fluidic actuator activating task 812 activates the first fluidic actuator in the first time group to perform the activated sense measurement of the first fluidic actuator. The activation pulse suppressing task 814 suppresses an activation pulse to the first fluidic actuator in a second time group that follows the first time group to perform a reference measurement for the first fluidic actuator in the second time group, the second time group comprising a plurality of activation intervals for respective fluidic actuators, and the suppressing of the activation pulse to the first fluidic actuator preventing activation of the first fluidic actuator.

In examples where the controller 110 or 120, or decoder 122 is implemented as a combination of a hardware processing circuit and machine-readable instructions, the controller can include a processor and a non-transitory machine-readable or computer-readable storage medium storing machine-readable instructions executable on the processor to perform respective tasks.

A processor can include a microprocessor, a core of a multi-core microprocessor, a microcontroller, a programmable integrated circuit, a programmable gate array, or another hardware processing circuit. Machine-readable instructions executable on a processor can refer to the instructions executable on a single processor or the instructions executable on multiple processors.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing device comprising:

a plurality of fluidic actuators; and a decoder to:

detect that an activated sense measurement is to be performed for a first fluidic actuator of the plurality of fluidic actuators in a first time group comprising a plurality of activation intervals for respective fluidic actuators; and in response to detecting that the activated sense measurement is to be performed for the first fluidic actuator in the first time group:

activate the first fluidic actuator in the first time group to perform the activated sense measurement for the first fluidic actuator, and suppress an activation pulse to the first fluidic actuator in a second time group that follows the first time group to perform a reference measurement for the first fluidic actuator in the second time group, the second time group comprising a plurality of activation intervals for respective fluidic actuators.

2. The fluid dispensing device of claim 1, further comprising:

a storage element associated with the first fluidic actuator, the storage element to store a sense measurement indicator that is set active to indicate that the activated sense measurement is to be performed for the first fluidic actuator.

3. The fluid dispensing device of claim 2, further comprising a controller to:

set the sense measurement indicator in the storage element active in the first time group, wherein the storage element is to maintain the sense measurement indicator set active in the second time group to enable the reference measurement in the second time group.

4. The fluid dispensing device of claim 3, wherein the storage element comprises a flip-flop that maintains a data state of the sense measurement indicator unless changed by the controller.

5. The fluid dispensing device of claim 2, wherein the storage element is individually associated with the first fluidic actuator.

6. The fluid dispensing device of claim 2, wherein the storage element is associated with a group of fluidic actuators including the first fluidic actuator.

7. The fluid dispensing device of claim 1, wherein the decoder is to suppress the activation pulse to the first fluidic actuator in a sense measurement interval of the second time group in response to activation, in the second time group, of a signal indicating that the reference measurement is to be performed.

8. The fluid dispensing device of claim 7, wherein the signal is maintained inactive in the first time group.

9. The fluid dispensing device of claim 1, wherein the activated sense measurement in the first time group is of a first condition of the first fluidic actuator, and the reference measurement in the second time group is of a different second condition of the first fluidic actuator.

10. The fluid dispensing device of claim 1, wherein the decoder is to further:

detect that the first fluidic actuator is to be activated in the first time group; and in response to detecting that the first fluidic actuator is to be activated in the first time group and the activated sense measurement is to be performed of the first fluidic actuator in the first time group:

suppress activation of the first fluidic actuator in a first activation interval of the first time group, activate the first fluidic actuator in a sense measurement interval of the first time group to perform the activated sense measurement of the first fluidic actuator, and suppress the activation pulse to the first fluidic actuator in a sense measurement interval of the second time group.

11. The fluid dispensing device of claim 1, wherein the respective fluidic actuators associated with the plurality of activation intervals are selected by respective different addresses.

12. A fluidic die comprising:

a plurality of fluidic actuators arranged as primitives of fluidic actuators;

a plurality of storage elements to store sense measurement indicators to indicate whether or not respective fluidic actuators or primitives are to be subject to an activated sense measurement; and a decoder to:

detect, based on a sense measurement indicator in a storage element of the plurality of storage elements, that an activated sense measurement is to be performed for a first fluidic actuator of the plurality of fluidic actuators in a first time group comprising a plurality of activation intervals for respective fluidic actuators; and in response to detecting that the activated sense measurement is to be performed for the first fluidic actuator in the first time group:

activate the first fluidic actuator in the first time group to perform the activated sense measurement of the first fluidic actuator, and suppress an activation pulse to the first fluidic actuator in a second time group that follows the first time group to perform a reference measurement for the first fluidic actuator in the second time group, the second time group comprising a plurality of activation intervals for respective fluidic actuators, and the suppressing of the activation pulse to the first fluidic actuator preventing activation of the first fluidic actuator.

13. The fluidic die of claim 12, further comprising a controller to:

deactivate a reference measurement signal in the first time group; and activate the reference measurement signal in a sense measurement interval of the second time group.

14. A method of a fluid dispensing device, comprising:

detecting based on control data that a first fluidic actuator of the plurality of fluidic actuators is to be activated in a first time group comprising a plurality of activation intervals for respective fluidic actuators;

detecting that an activated sense measurement is to be performed for the first fluidic actuator in the first time group; and in response to detecting that the first fluidic actuator is to be activated in the first time group and that the activated sense measurement is to be performed for the first fluidic actuator in the first time group:

suppressing activation of the first fluidic actuator in a first activation interval of the first time group;

activating the first fluidic actuator in a sense measurement interval of the first time group to perform the activated sense measurement of the first fluidic actuator, and suppressing an activation pulse to the first fluidic actuator in a second time group that follows the first time group to perform a reference measurement for the first fluidic actuator in the second time group, the second time group comprising a plurality of activation intervals for respective fluidic actuators.

15. The method of claim 14, wherein the activated sense measurement in the first time group is a peak measurement.

* * * * *